United States Patent [19]

Bosch et al.

[11] Patent Number: 4,899,815

[45] Date of Patent: Feb. 13, 1990

[54] TANK RETAINING STRIP FOR HEAT EXCHANGERS

[75] Inventors: Daniel J. Bosch; John D. Real, both of Racine; Michael P. Devine, Kenosha, all of

[73] Assignee: Modine Manufacturing Co., Racine, Wis.

[21] Appl. No.: 314,157

[22] Filed: Feb. 23, 1989

[51] Int. Cl.[4] ..... F28F 9/02

[52] U.S. Cl. ..... 165/173; 165/175; 403/364

[58] Field of Search ..... 165/149, 173, 175; 403/315, 316, 338, 364; 285/338, 349

[56] References Cited

U.S. PATENT DOCUMENTS

| | | | |
|---|---|---|---|
| 3,352,584 | 11/1967 | Engel . | |
| 4,287,994 | 9/1981 | Klein . | |
| 4,324,290 | 4/1982 | Moranne . | |
| 4,351,390 | 9/1982 | Argyle et al. . | |
| 4,406,374 | 9/1983 | Yedor . | |
| 4,485,867 | 12/1984 | Melnyk et al. . | |
| 4,546,823 | 10/1985 | Melnyk . | |
| 4,618,064 | 10/1986 | Viklund . | |
| 4,645,002 | 2/1987 | Keyzer | 165/175 |
| 4,682,672 | 7/1987 | Berger et al. | 184/106 |
| 4,707,905 | 11/1987 | Clair . | |

FOREIGN PATENT DOCUMENTS

| | | | |
|---|---|---|---|
| 2703528 | 8/1978 | Fed. Rep. of Germany | 165/173 |
| 1052834 | 11/1983 | U.S.S.R. | 165/173 |

*Primary Examiner*—Martin P. Schwadron
*Assistant Examiner*—Allen J. Flanigan
*Attorney, Agent, or Firm*—Wood, Dalton, Phillips, Mason & Rowe

[57] ABSTRACT

Improper assembly and/or dissociation due to improper handling of a tank 10 to header plate 14 joint in a heat exchanger is avoided through the use of a retaining strip 50 having fingers 54 receivable in slots 36 in an upstanding flange 26 surrounding a sealing surface 28 on the header plate 14. The fingers 54 are provided with hook-like formations 60, 62, 64 which lodge behind a surface 44 of the flange 26.

15 Claims, 4 Drawing Sheets

TANK RETAINING STRIP FOR HEAT EXCHANGERS

FIELD OF THE INVENTION

This invention relates to heat exchangers such as, but not limited to, vehicular radiators and more particularly, to tank retaining strips for use with such heat exchangers.

BACKGROUND OF THE INVENTION

Heat exchangers such as vehicular radiators include cores which are defined by a plurality tube and interleaved fins which terminate at opposed ends in header plates. To provide a means of directing liquid to the interior of the tubes, a so-called tank is secured to each header plate and some sort of means provided to introduce liquid into the tank.

This, of course, means that the tank must be properly sealed to the header plate or else a leaky system will result. Consequently, much effort has been expended in providing various means whereby tanks may be secured to header plates.

Frequently, relatively permanent connections have been attempted. This is undesirable from the standpoint that when the core becomes unusable, the entire heat exchanger including the tanks is disposed of and the replacement cost is more expensive. Consequently, from this standpoint, it is desirable to provide a readily severable but tightly sealed header to tank joint.

Another consideration arises when the header plates and the tank are of dissimilar materials. State of the art vehicular radiator design calls for the tanks to be made of plastic whereas the cores are copper-brass or aluminum in most cases. Plastic tanks reduce the overall weight of the heat exchanger, and thus the vehicle and contribute to fuel efficiency.

In establishing a sealed connection between a tank and a header plate made of dissimilar materials, some care must be exercised to assure that the softer of the two materials is not damaged in the joining operation.

In order to meet these and other needs, Keyzer in U.S. Pat. No. 4,645,002 issued Feb. 24, 1987, has proposed a removable, tank retaining strip for securing the heat exchanger tank to a header plate. The Keyzer construction is shown in FIGS. 1 and 2 hereof and is seen to include a tank 10 having a peripheral, outwardly extending flange 11 applied to a header plate 14. Extending through the header plate 14 is a plurality of open tube ends 16 of flattened tubes 18 which extend in generally parallel relation to each other to another header plate (not shown) and between which serpentine fins 20 extend in a conventional fashion. The body of the header plate 14 is surrounded by a peripheral groove 22. The groove 22 includes an inner wall 24 an upstanding outer wall or flange 26 and a bottom 28 defining a seal receiving surface. Located within the groove 22 is a resilient seal 30 which is compressed against the sealing surface 28 at the bottom of the groove 22 by abutment with the sealing surface 32 on the underside of the peripheral flange 11 of the tank 10.

By compressing the seal 30, a peripheral seal at the tank to header plate joint is maintained. In order to compress the seal, the tank 10, and specifically, the peripheral flange 11, includes an upper, pressure receiving surface 34 that is opposite the sealing surface 32.

Located about the upstanding flange 26 is a row of apertures made up of elongated slots 36. An elongated retaining strip 38 extends along the upstanding flange 26 as can be best seen in FIG. 1 and includes a plurality of inwardly directed fingers 40 that extend into corresponding ones of the slots 36 to overlie and abut the surface 34 of the flange 11. As a consequence, the flange 11 can be held in compressing relation against the seal 30.

To prevent dissociation of the strip 38, Keyzer provides deformations or dimples 42 in each finger 40 which extend upwardly. Because the resilience of the seal 30 will exert an upward bias against the flange 11 which in turn will be applied to each of the fingers 40, the dimples 42 may lodge behind the innermost surface 44 of the upstanding flange 26 to provide a locking action.

As a consequence of this construction, a good peripheral seal may be maintained if assembly is properly accomplished. Furthermore, disassembly of a tank from a core is readily accomplished simply by exerting a force against the tank 10 to further compress the seal 30, allowing the strip 38 to be pulled away from the flange 26.

However, if the Keyzer strip is not properly installed, or if the heat exchanger employing the same is handled improperly, the retention provided by the strip may be lost. For example, because the strip is typically formed of relatively thin metal, it is subject to some flexure, being what might be termed only "semi-rigid". As a consequence, while certain of the fingers 40 may be fully located within their associated slots 36 and the dimples 42 properly oriented as shown in FIG. 2, it is possible that certain others of the fingers along the length of the upstanding flange 26 are not fully disposed within their associated slots 36 so as to allow the dimples 42 to accomplish their retaining purpose. When this occurs, cycling of the heat exchange during its operation may result in ultimate loosening of the strip and the formation of a leak at that location.

Similarly, if the assembled heat exchanger is mishandled, as by dropping the heat exchanger on one of the tanks, a sudden over-compression of the seal 30 may result, allowing the strip 38 and the fingers 40 to move and dissociate themselves. Again, leakage will occur.

The present invention is directed to overcoming one or more of the above problems.

SUMMARY OF THE INVENTION

It is the principal object of the invention to provide a new and improved tank retaining strip for use in a heat exchanger. More particularly, it is an object of the invention to provide such a strip wherein correct assembly to a heat exchanger is facilitated and wherein inadvertent dissociation is prevented.

An exemplary embodiment of the invention achieves the foregoing objects in a heat exchanger construction including a header plate having a peripheral seal receiving surface. A resilient seal engages the surface and an upstanding flange surrounds the surface. An aligned row of apertures is located in the flange above the surface and a tank having a peripheral outwardly directed flange is disposed within the upstanding flange and has a first surface sealed against and compressing the seal against the header plate surface and an opposed surface nominally aligned with the row of apertures. A tank flange retainer includes an elongated strip with a plurality of fingers and is disposed on the side of the upstanding flange opposite the surface with the fingers extending through the apertures and lodged against the upstanding flange oppositely of the strip in overlying relation to the tank flange to prevent removal of the strip.

According to one facet of the invention, the fingers are hook-like formations. Preferably, the hook-like formations all include a nose and all of the noses extend in the same direction of elongation of the strip.

The invention contemplates that a clip be disposed in one of the apertures in abutting relation to corresponding hook-like formation to prevent the same from moving appreciably in the aperture in which it is received. This thereby prevents the strip from moving appreciably relative to the upstanding flange to prevent inadvertent dissociation.

According to another facet of the invention, the strip is provided with means which prevent any of the fingers from lodging against the upstanding flange in locking relationship unless all of the fingers lodge against the upstanding flange in locking relationship. Thus, complete and proper assembly is facilitated.

Other objects and advantages will become apparent from the following specification taken in connection with the accompanying drawings.

DESCRIPTION OF THE PREFERRED EMBODIMENTS

Figure 1:
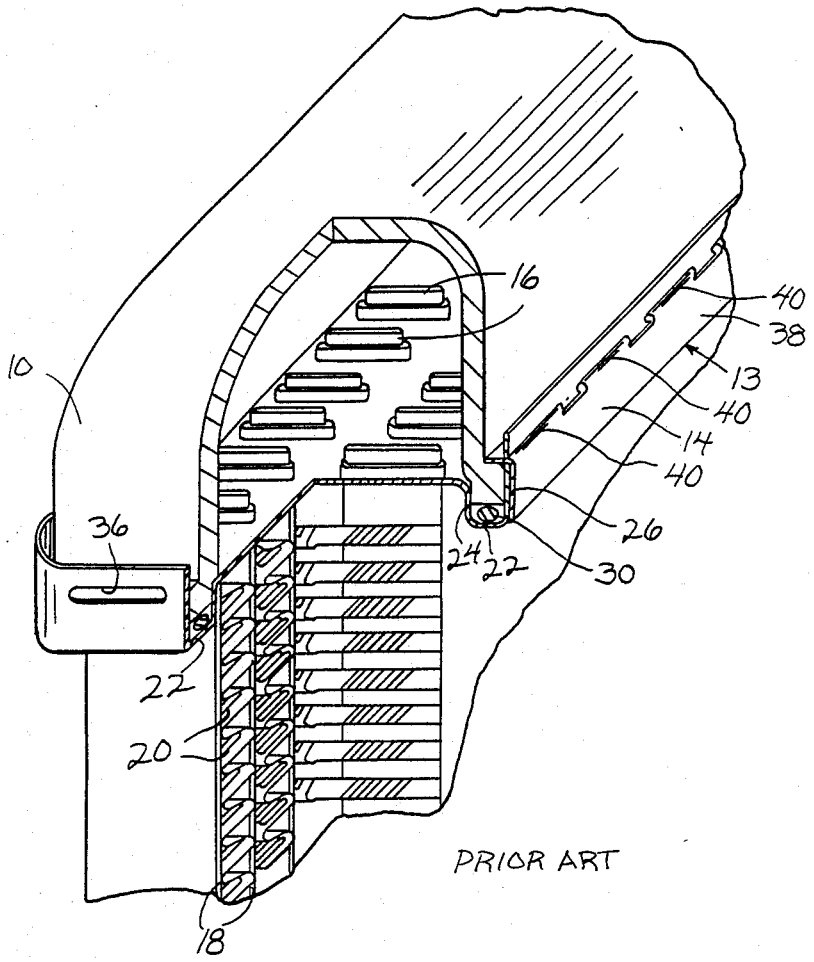
FIG. 1 is a fragmentary perspective view of a conventional heat exchanger assembly utilizing a tank retaining strip made according to the prior art, specifically, according to U.S. Pat. No. 4,645,002 issued Feb. 24, 1987 to Keyzer.
Figure 2:
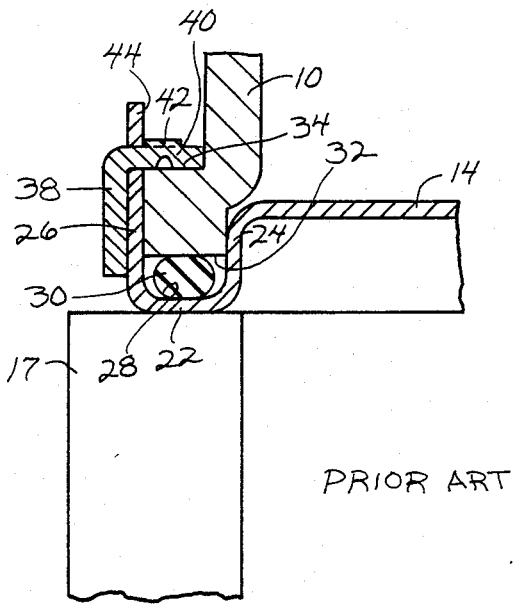
FIG. 2 is an expanded, fragmentary, sectional view of part of the prior art construction.

The present invention is directed to a heat exchanger such as a vehicular radiator much like that illustrated in FIGS. 1 and 2 and described previously herein. According to the invention, however, the strip 38 and associated fingers 40 along with the dimples 42 on the fingers 40 of the prior art construction are dispensed with in favor of a strip made according to the invention. The remainder of the heat exchanger construction may be the same and in the interest of brevity, will not be described again herein. For clarity, however, the same reference numerals employed in describing the prior art construction other than the strip 38, fingers 40 and dimples 42 will be used where appropriate.

Figure 3:
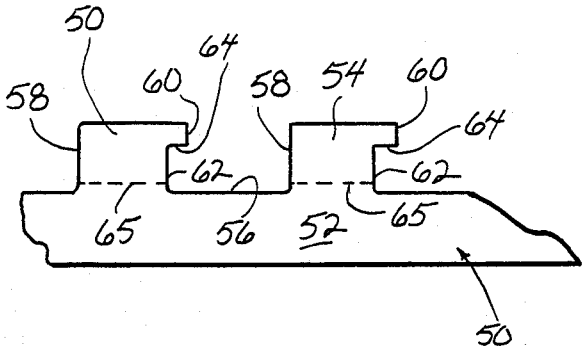
FIG. 3 illustrates a blank utilized in forming a strip made according to the invention.
Figure 6:
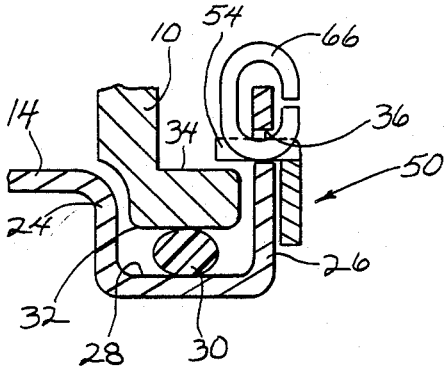
FIG. 6 is a fragmentary, sectional view illustrating the use of a retaining clip according to the invention.
Figure 7:
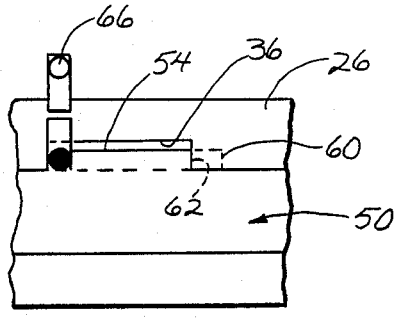
FIG. 7 is a fragmentary, side elevation taken from the right of FIG. 6.

A retaining strip made according to the invention is generally designated 50 and may be stamped from relatively thin sheet metal in the form of a blank shown in FIG. 3. The blank includes an elongated, main body or strip section 52. Fingers 54 extend from one edge 56 of the strip 52 and have opposed sides 58 and 60 The width of the fingers between the sides 58 and 60 is just slightly less than the length of the slots 36.

As seen in FIG. 3, the sides 60 include notches 62 and the side 64 of each notch 62 remote from the strip 52 is parallel to the direction of elongation of the strip 52.

The fingers 54 are bent relative to the strip 52 by any suitable means generally along lines 65 to form the retaining strip of the invention. As in the prior art strip, an approximate 90° angle between the fingers 50 and the body of the strip 52 is utilized.

Figure 4:
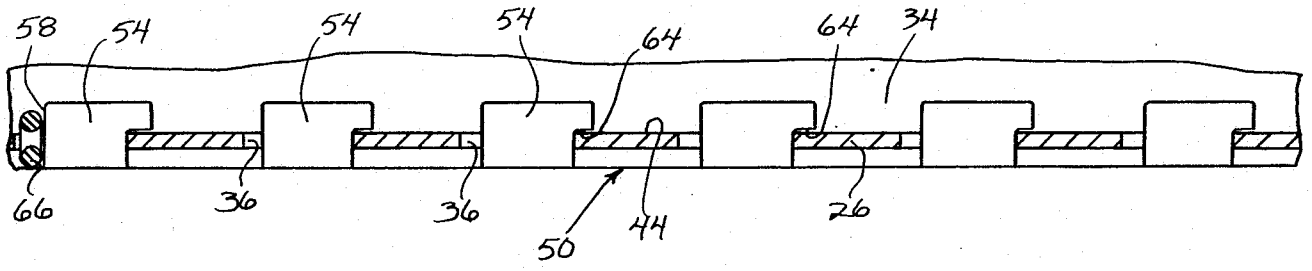
FIG. 4 is a fragmentary view showing the retaining strip of the invention applied to an otherwise conventional heat exchanger construction such as illustrated in FIG. 1.

As seen in FIG. 4, one of the strips 50 has been applied to the slots 36 in the upstanding flange 26 and brought into overlying relationship and in abutment with the upper surface 34 of the flange 11 to urge the same downwardly thereby compressing the seal 30. As can be seen, the strip 50 has been shifted somewhat to the right as viewed in FIG. 4 so as to bring the sides 64 of the notches 62 into a position where they are lodged against the inner surface 44 of the flange 26. In other words, the notches 62 serve as hook-like formations allowing the fingers 54 to be literally hooked to the flange 26.

To prevent inadvertent dissociation, a wire or plastic clip such as a ring 66 may be disposed in any one of the slots 36 in abutting relation with the side 58 of the corresponding finger 54. This will prevent that finger 54 from being moved to the left as viewed in FIG. 4 and that in turn will prevent entire the strip 50 from being similarly moved. As a consequence, once assembly has been made and the clip 66 applied, disassembly cannot occur.

This feature of the invention is rather advantageous since, as will be seen, the clip 66 cannot be applied to the structure unless the strip 50 is properly installed. This in turn means that an inspector need only look for the clip 66 and observe the same to be assured that there has been proper installation.

Figure 5:
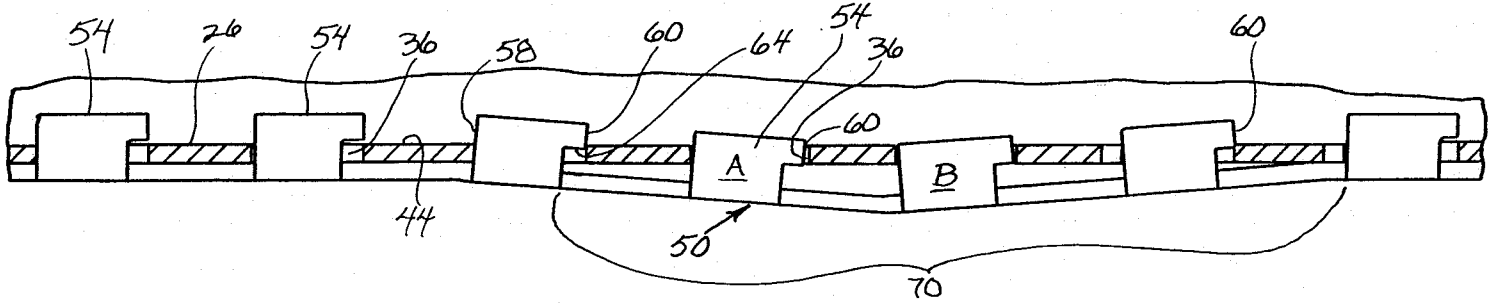
FIG. 5 is a view similar to FIG. 4 but illustrating how the invention prevents improper assembly.

Turning now to FIG. 5, it will be appreciated that because the strip 50 will typically be made from relatively thin metal, it can only be characterized as semi-rigid. Thus, the same may bow as in the general area bracketed at 70 in FIG. 5. If it is attempted to install the strip with the bow 70 intact, the strip 50 cannot be shifted laterally, here to the right as seen in FIG. 5, to bring the surfaces 64 of the fingers 54 into a position where they lodge against the surface 44 of the flange 26. This is due to the fact that what remains of the sides 60 of each finger 54 after the formation of the notch 62 acts as a nose which in turn blocks rightward movement of the corresponding finger 54, and thus the entire strip. As seen in FIG. 5, two of the fingers 54 have their noses defined by the sides 60 in such blocking relation. Those two fingers are designated A and B.

Thus, the surfaces 60 define a means that prevent any of the fingers 54 from moving into a lodging or locked position with relation to the surface 54 of the flange 26 unless all of the fingers 54 move into that position. Only when the latter has occurred can the clip 66 be applied since there will be no space between the sides 58 of the fingers 54 and a corresponding edge of the slots 36 as can be seen in FIG. 5. The noses defined by the surfaces 60 will block application of the clip 66 to any one of the slots 36 at the opposite end because there is insufficient room through which the clip 66 may pass.

Figure 8:
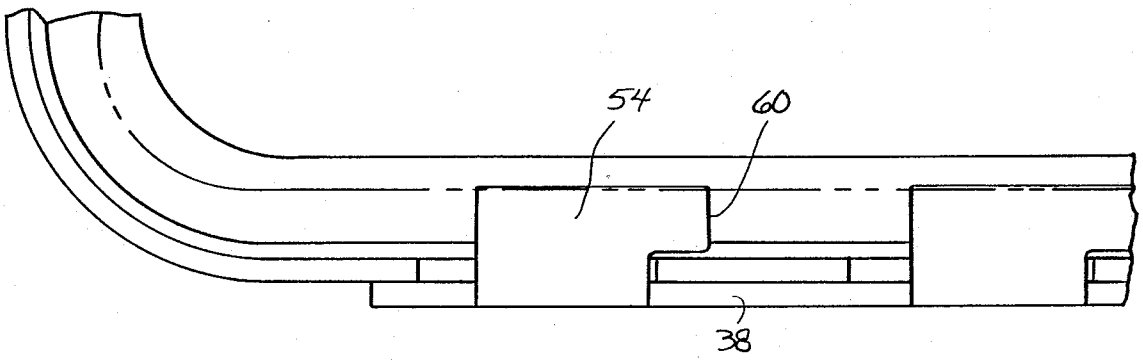
FIG. 8 is a view similar to FIG. 5 but of a modified embodiment of the invention.
Figure 9:
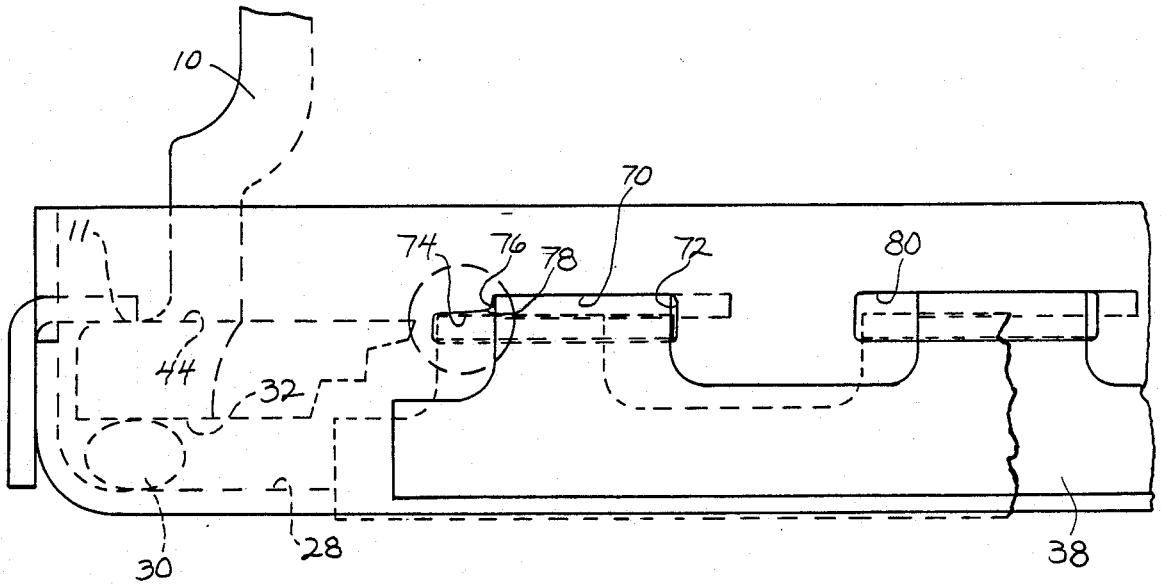
FIG. 9 is a fragmentary side elevation of the embodiment of FIG. 8.

A modified embodiment is illustrated in FIGS. 8 and 9 and where like components are employed, like reference numerals will be utilized. This embodiment differs from that just described only in that the slots 36 are dispensed with in favor of slots 70 which are in the shape of a flattened L. The total top to bottom length of one of the slots 70 is a little more than twice the thickness of the strip 38 and the upright leg 72 of each slot 70 is narrower than the horizontal leg 74; and the latter is closer to the sealing surface 28 than the former.

In addition, the length of the horizontal leg 74 in the direction of elongation of the strip 38 is slightly greater than the corresponding dimension of the fingers 54 at their maximum dimension. Also, the top to bottom dimension of the horizontal leg 74 is slightly greater than the thickness of the strip 38. As a consequence, the fingers 54 may be inserted into the slots 70 through the horizontal legs 74.

The length of the upstanding leg 72 in the direction of elongation of the strip 38 is less than that of the leg 74 and is slightly greater than the narrowest dimension of the fingers 54. Thus, once the fingers 54 have been inserted through the horizontal leg 74, the strip 38 may be shifted to the right as viewed in FIG. 9 and then the fingers shifted upwardly into the upstanding leg 70 and moved from the hatched position to the solid line position illustrated in FIG. 9. As a consequence, that side 76 of the finger opposite from the hook will abut an edge 78 of the upstanding leg 72 while being locked in place such that it cannot be dislodged. If desired, the L-shaped apertures 70 may be utilized along the entire length of the flange but it is only necessary that they be utilized at one location for each strip 38. Thus, as shown in FIG. 9, an adjacent aperture 80 is shaped as the apertures 36 but has increased top to bottom dimension so as to allow the shifting of the fingers as mentioned previously.

In this embodiment, the resiliency of the seal 30 is utilized to retain the fingers in the upper part of the apertures 70 or 80. More particularly, the tank 10 is caused to compress the seal 30 sufficiently so that the fingers 54 may be caused to enter the apertures 70 and 80. Upon release of the compressing pressure on the tank, the resiliency of the seal 30 will urge the sealing surface 32 of the flange 44 upwardly as viewed in FIGS. 8 and 9. The flange 44 will in turn act against the fingers 54 to hold them in the desired position.

Figure 10:
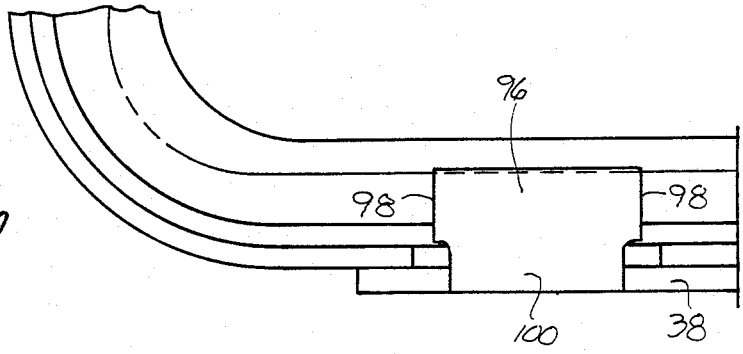
FIG. 10 is a view similar to FIG. 8 but of still a further modified embodiment.
Figure 11:
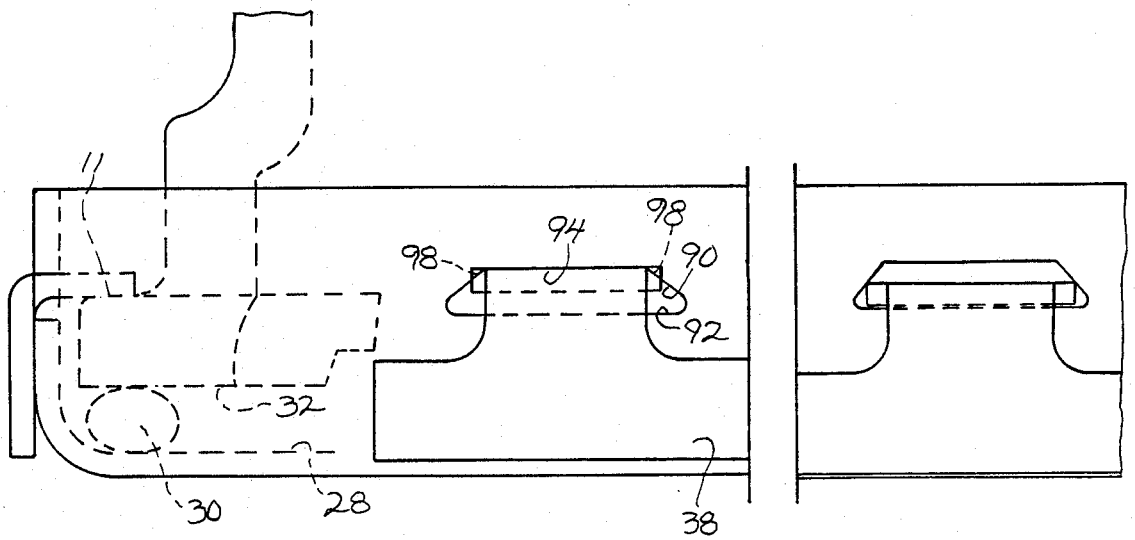
FIG. 11 is a view similar to FIG. 9 but of the embodiment of FIG. 10.

FIGS. 10 and 11 show still another embodiment of the invention. This embodiment also makes use of the resiliency of the seal 30. According to this embodiment of the invention, trapezoidal apertures 90 are utilized and have their major bases 92 downwardly and their minor bases 94 remote from the surface 28. According to this embodiment of the invention, the hook-like formations are T-shaped as shown at 96 and have oppositely directed noses 98 extending from the base of the finger 100.

According to this embodiment of the invention, the apertures 90 have a top to bottom dimension that is on the order of twice the thickness of the strip 38 and at a location midway between the bases 92 and 94, have a dimension that is slightly greater than the dimension from one nose 98 to the other on a given hook-like formation 96. Consequently, the fingers may be inserted into the apertures 90 adjacent the base 92 and allowed to move upwardly within the apertures 90 as a result of the resiliency of the seal 30. When such occurs, as can be seen in FIG. 11, the noses 98 are lodged behind part of the flange for retaining purposes. One advantage of the embodiment of FIGS. 10 and 11 is that one need only insert the fingers 100 into the apertures 90 and allow the resiliency of the seal 30 to takeover. That is to say, there is no need to provide a lateral shifting of the strip 38 as is necessary with the prior embodiments.

It will accordingly be appreciated that an improved retaining strip made according to the invention retains all of the advantages of the prior art strip of Keyzer in terms of being usable and providing a releasable but readily sealed tank to header plate connection for a heat exchanger. At the same time, the disadvantages associated with the possibility of improper assembly and/or improper handling have been eliminated.

We claim:

1. A heat exchanger comprising:

a header plate having a peripheral seal receiving groove;

a resilient seal disposed in said groove;

an upstanding flange surrounding said groove;

an aligned row of apertures in said flange above the bottom of said groove;

a tank having a peripheral outwardly directed flange located in said groove and having a first surface sealed against and compressing said seal and an opposed surface nominally aligned with said row of apertures; and a tank flange retainer including an elongated strip with a plurality of hook-like formations, said strip being disposed on the side of said upstanding flange opposite said groove with said formations extending through said apertures and lodged against said upstanding flange oppositely of said strip in overlying relation to said tank flange.

2. The heat exchanger of claim 1 wherein each said hook-like formation includes a nose and all of the noses extend in the direction of elongation of said strip.

3. The heat exchanger of claim 1 further including a clip in one of said apertures and abutting the corresponding hook-like formation to prevent the same from moving appreciably in said one aperture thereby preventing said strip from moving appreciably relative to said upstanding flange.

4. The heat exchanger of claim 1 wherein said apertures are narrower at their location farthest from said groove than at their location nearest said groove.

5. The heat exchanger of claim 4 wherein the dimension of each hook-like formation in the direction of elongation of said strip is less than the dimension of the corresponding aperture at said nearest location and greater than the dimension of corresponding aperture at said farthest location.

6. The heat exchanger of claim 1 wherein said hook-like formations are T-shaped.

7. A heat exchanger comprising:

a header plate having a peripheral seal receiving surface;

a resilient seal engaging said surface;

an upstanding flange surrounding said surface;

an aligned row of apertures in said flange above said surface;

a tank having a peripheral outwardly directed flange disposed within said upstanding flange and having a first surface sealed against and compressing said seal against said header plate surface and an opposed surface nominally aligned with said row of apertures; and a tank flange retainer including an elongated strip with a plurality of fingers terminating in hook-like noses disposed on the side of said upstanding flange opposite said seal receiving surface with said fingers extending through said apertures such that said noses lodge against said upstanding flange oppositely of said strip in overlying relation to said tank flange and in engagement with said opposed surface.

8. The heat exchanger of claim 7 wherein said apertures are relatively narrow remote from seal receiving surface and relatively wide close to said seal receiving surface and said hook like hoses are sized to as to be movable into and out of said apertures close to said seal receiving surface but captured in said apertures when remote from said seal receiving surface, said resilient seal urging said tank away from said seal receiving surface such that said tank flange urges said noses into the narrow part of the corresponding aperture.

9. The heat exchanger of claim 8 where said noses extend oppositely from both sides of said finger.

10. The heat exchanger of claim 9 wherein said apertures are trapezoidal.

11. The heat exchanger of claim 8 wherein said apertures are L-shaped.

12. A heat exchanger comprising:

a header plate having a peripheral seal receiving surface;

a resilient seal engaging said surface;

an upstanding flange surrounding said surface;

an aligned row of apertures in said flange above the bottom of said groove;

a tank having a peripheral outwardly directed flange disposed within said upstanding flange and having a first surface sealed against and compressing said seal and an opposed surface nominally aligned with said row of apertures;

a tank flange retainer including an elongated, semi-rigid strip with a plurality of fingers, said strip being disposed on the side of said upstanding flange opposite said seal receiving surface with said fingers extending through said apertures and lodged against said upstanding flange oppositely of said strip in overlying relation to said tank flange to prevent removal of said strip; and means on said strip for preventing any of said fingers from said lodging against said upstanding flange unless all of said fingers lodge against said upstanding flange.

13. The heat exchanger of claim 12 wherein said fingers include hook-like formations all opening in the same direction of elongation of said strip and said preventing means comprise noses on said hook-like formations.

14. The heat exchanger of claim 13 wherein said strip is generally transverse to said fingers.

15. The heat exchanger of claim 13 wherein said apertures are slots elongated in the direction of elongation of said strip and having a length slightly greater than the width of said fingers at said noses.

* * * * *